US009287598B2

(12) United States Patent
Tantawi et al.

(10) Patent No.: US 9,287,598 B2
(45) Date of Patent: Mar. 15, 2016

(54) RF WINDOW ASSEMBLY COMPRISING A CERAMIC DISK DISPOSED WITHIN A CYLINDRICAL WAVEGUIDE WHICH IS CONNECTED TO RECTANGULAR WAVEGUIDES THROUGH ELLIPTICAL JOINTS

(71) Applicant: The Board of Trustees of the Leland Stanford Junior University, Palo Alto, CA (US)

(72) Inventors: Sami G. Tantawi, Stanford, CA (US); Valery A. Dolgashev, San Carlos, CA (US); Anahid D. Yeremian, Menlo Park, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 0 days.

(21) Appl. No.: 14/271,784

(22) Filed: May 7, 2014

(65) Prior Publication Data

US 2014/0333395 A1 Nov. 13, 2014

Related U.S. Application Data

(60) Provisional application No. 61/821,392, filed on May 9, 2013.

(51) Int. Cl.

| | |
|---|---|
| ***H01P 1/08*** | (2006.01) |
| ***H01J 23/36*** | (2006.01) |
| ***H01P 5/08*** | (2006.01) |
| ***H01J 25/10*** | (2006.01) |
| ***H01J 23/12*** | (2006.01) |

(52) U.S. Cl.

CPC . *H01P 1/08* (2013.01); *H01J 23/12* (2013.01); *H01J 23/36* (2013.01); *H01J 25/10* (2013.01); *H01P 5/082* (2013.01)

(58) Field of Classification Search

CPC ..... H01P 1/08; H01P 5/082
USPC ..... 333/252, 21 R
See application file for complete search history.

(56) References Cited

U.S. PATENT DOCUMENTS

| | | | | | |
|---|---|---|---|---|---|
| 3,110,000 | A | * | 11/1963 | Churchill | 333/208 |
| 3,183,459 | A | * | 5/1965 | Caputo et al. | 333/252 |
| 3,775,709 | A | * | 11/1973 | Firmain et al. | 333/252 |
| 3,860,891 | A | * | 1/1975 | Hiramatsu | 333/21 R |

* cited by examiner

*Primary Examiner* — Benny Lee
(74) *Attorney, Agent, or Firm* — Lumen Patent Firm

(57) ABSTRACT

A high-power microwave RF window is provided that includes a cylindrical waveguide, where the cylindrical waveguide includes a ceramic disk concentrically housed in a central region of the cylindrical waveguide, a first rectangular waveguide, where the first rectangular waveguide is connected by a first elliptical joint to a proximal end of the cylindrical waveguide, and a second rectangular waveguide, where the second rectangular waveguide is connected by a second elliptical joint to a distal end of the cylindrical waveguide.

6 Claims, 5 Drawing Sheets

*(a)*

*(b)*

RF WINDOW ASSEMBLY COMPRISING A CERAMIC DISK DISPOSED WITHIN A CYLINDRICAL WAVEGUIDE WHICH IS CONNECTED TO RECTANGULAR WAVEGUIDES THROUGH ELLIPTICAL JOINTS

CROSS-REFERENCE TO RELATED APPLICATIONS

This application claims priority from U.S. Provisional Patent Application 61/821,392 filed May 9, 2013, which is incorporated herein by reference.

STATEMENT OF GOVERNMENT SPONSORED SUPPORT

This invention was made with Government support under grant (or contract) no. DE-AC02-76SF00515 awarded by the Department of Energy. The Government has certain rights in this invention.

FIELD OF THE INVENTION

The present invention relates generally to high power microwave systems. More specifically, it relates to RF window designs for high power microwave devices such as klystrons.

BACKGROUND OF THE INVENTION

RF windows are used to separate high and low vacuum regions in high power microwave systems, such as klystrons. RF breakdowns in megawatt environments could damage the window. What is needed is an RF window to reduce electric and magnetic fields in the waveguide joints and the ceramic.

SUMMARY OF THE INVENTION

To address the needs in the art, a high-power microwave RF window is provided that includes a cylindrical waveguide, where the cylindrical waveguide includes a ceramic disk concentrically housed in a central region of the cylindrical waveguide, a first rectangular waveguide, where the first rectangular waveguide is connected by a first elliptical joint to a proximal end of the cylindrical waveguide, and a second rectangular waveguide, where the second rectangular waveguide is connected by a second elliptical joint to a distal end of the cylindrical waveguide.

In one aspect of the invention, the high-power microwave RF window is capable of supporting a traveling wave inside the ceramic disk.

According to another aspect of the invention, the high-power microwave RF window is capable of separating vacuum from atmospheric pressures in a klystron microwave system.

In a further aspect of the invention, the high-power microwave RF window is capable of operating in multi-tens of megawatt power environment.

According to one aspect of the invention, the high-power microwave RF window is capable of minimizing a normal component of an electric field on the surface of the ceramic disk, wherein a traveling wave is created inside the ceramic disk.

In yet another aspect of the invention, the high-power microwave RF window is capable of minimizing a surface magnetic and electric fields on the joints between the circular and rectangular waveguides.

DETAILED DESCRIPTION OF THE INVENTION

In ultra high power RF systems the window between vacuum and atmosphere is one of the components most prone to failure. Improving the reliability of this critical component in a high power environment will increase the reliability of the entire system and reduce the operation price.

In one aspect, the present invention provides a pillbox style RF window with elliptical joint between the circular and rectangular guide. Joint geometry is optimized to create a traveling wave inside the ceramic region and minimize the electric and magnetic field on the surfaces. The RF window is able to separate vacuum from atmosphere in high power microwave systems, such as klystrons. This window is designed to operate in multi-megawatt power environment without faults.

Figure 1:
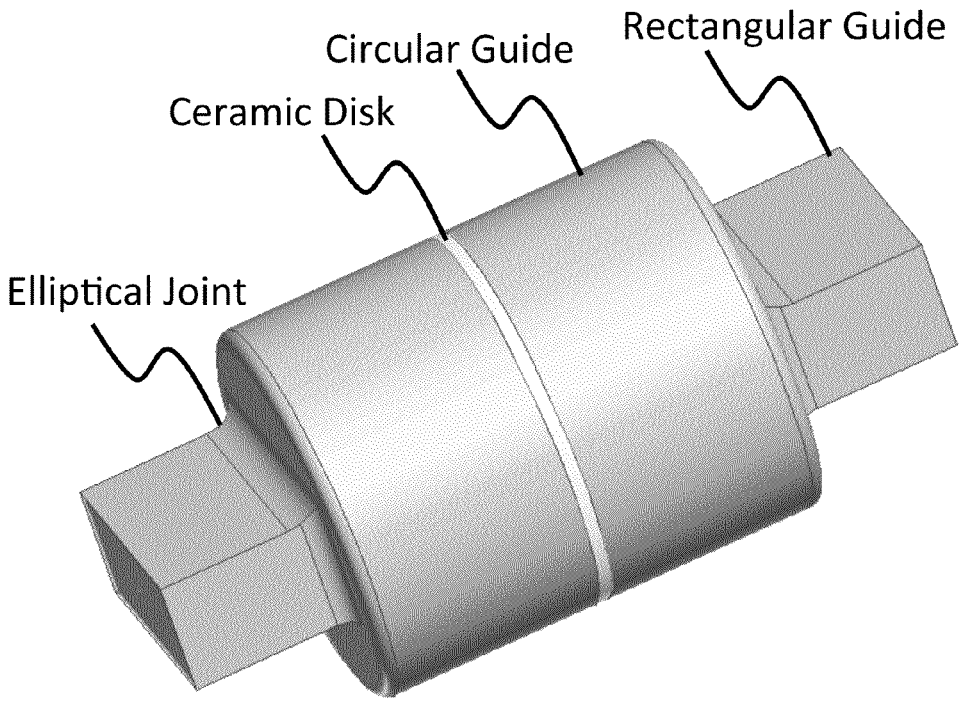
FIGS. 1*a*-1*b* show perspective views of a high-power microwave RF window in full view and one quadrant view, according to one embodiment of the invention.
Figure 1:
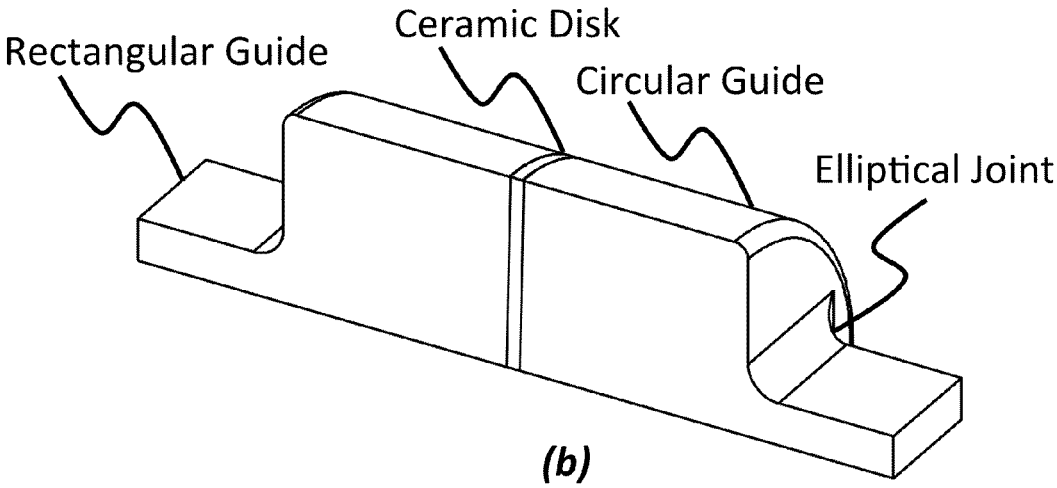

The current invention provides reduced electric and magnetic fields in ceramics and waveguide joints of RF windows. Specifically, the normal component of the electric field on the ceramic surface is minimized and a traveling wave is created inside the ceramic. This is achieved by optimizing the shape of the window and the geometry of the joint between the circular waveguide to the rectangular waveguide. The advantageous features of the window are achieved by optimizing the shape of the window and the geometry of the joint only and without additional matching elements. The matching elements increase complexity and decrease reliability, thus avoiding them is an important feature of this design. FIGS. 1*a*-1*b* show perspective views of a high-power microwave RF window in full view and one quadrant view, respectively, according to one embodiment of the invention. As shown in FIG. 1*a*, the high-power microwave window includes rectangular guides, circular guides, a ceramic disc and elliptical joints.

This RF window design has superior performance compared to any existing windows in high power RF sources and RF particle accelerators. It is applicable for industrial, medical, military and research applications.

The design can be used at any frequency, first by scaling all dimensions and then making minor optimization due to variation in manufacturing techniques and material properties for the given frequency.

An exemplary high-power microwave RF window was built and successfully tested at SLAC for the ILC prototype L-band positron source. A large number of accelerators in the world, including the SLAC linac operate at S-band. Thus this window, which operates comfortably at 65 MW peak power in S-band, is of great importance for many accelerators. Particular attention was paid to mitigate the high fields on the ceramic and the metal. Trapped and so-called ghost modes were investigated to assure that such modes are outside klystron bandwidths. The present invention can replace the pair of windows in the current the 5045 klystrons by a single window of this design.

To minimize the fields on the ceramic, the traveling wave window approach was implemented, according to one embodiment of the invention. Here, the basic design requirements of the window and the values achieved in simulation are presented in Table 1.

TABLE 1

S-Band Window Design Parameters

| Parameter | Required | Achieved |
|---|---|---|
| Frequency (MHz) | 2856 | 2856 |
| 3 dB BW (MHz) | ≥20 | ≥100 |
| Reflection (S11) | <−20 dB | <−70 dB |
| Peak Power (MW) | 65 MW | 65 MW |
| Peak E on Ceramic (MV/m) | Minimize | 1.75 |
| Peak H on Ceramic (KA/m) | Minimize | 17 |
| Peak E (MV/m) | Minimize | 11 |
| Peak H (KA/m) | Minimize | 20 |

The ceramic is housed in a circular waveguide. The inventors minimized the fields on the metal surfaces by optimizing the shape of the joint between the circular and rectangular waveguide. FIG. 1*b* shows a quadrant of the window.

To characterize the exemplary embodiment, namely the S-band version of the window, the commercial code CASCADE™ was used for the initial simulations. CASCADE™ uses mode-matching for rapid S parameter analysis and optimization of 2-port passive waveguide components and calculation of frequency and Q of resonators. The 3-D finite-element code HFSS was then used for the final design. For the nominal case of $\epsilon$=9.6 and thickness of 4 mm the reflection at 2856 MHz is less than −90 dB and the bandwidth at −20 dB is 50 MHz and more than 100 MHz at −3 dB. The reflection is less than −45 dB at 2856 MHz at ±0.2 mm from nominal.

Regarding reflection vs. frequency for the window with varying permittivity of the ceramic, keeping the ceramic thickness at 4 mm, the ceramic permittivity is varied in $\epsilon$=0.2 increments on either side of the nominal. The reflection is less than −35 dB at 2856 MHz in the worst case of $\epsilon$=9.6±0.4, which is satisfactory for a practical design.

Figure 2:
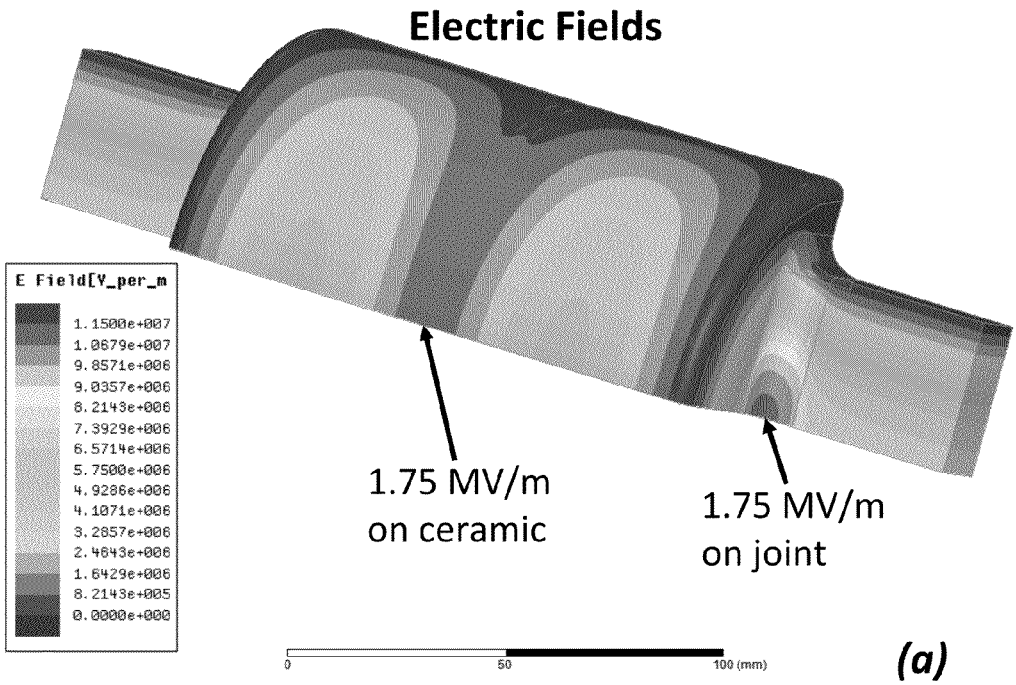
FIGS. 2*a*-2*b* show perspective views of a surface electric field on a window quadrant scaled for 65 MW power transmitted through the whole high-power S-band RF window, according to one embodiment of the invention. The fields here are shown for a specific window, field magnitudes will be different in case of different frequency bands.
Figure 2:
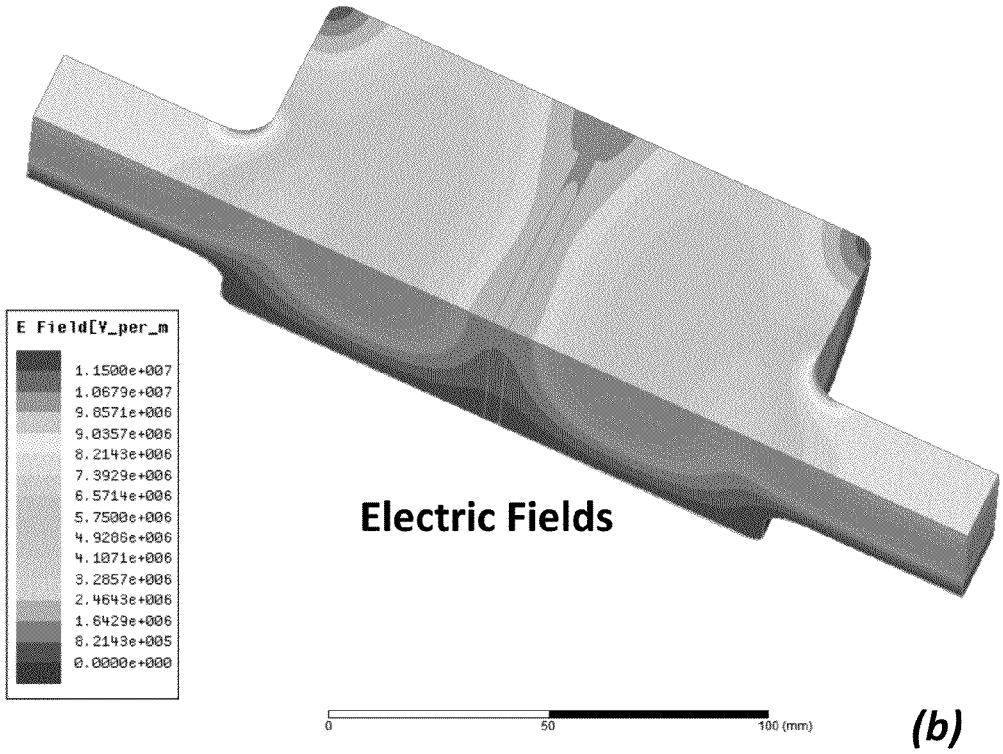

The maximum electric and magnetic fields on the metal appear on the elliptically-shaped joint between the circular and rectangular waveguides FIGS. 2*a*-2*b* show that at 65 MW through the window, the maximum electric field on the metal in area on the joints between circular and rectangular waveguides is 11 MV/m and the maximum electric field in the ceramic is 1.75 MV/m, and the maximum electric field on the joint is 1.75 MV/m.

Figure 3:
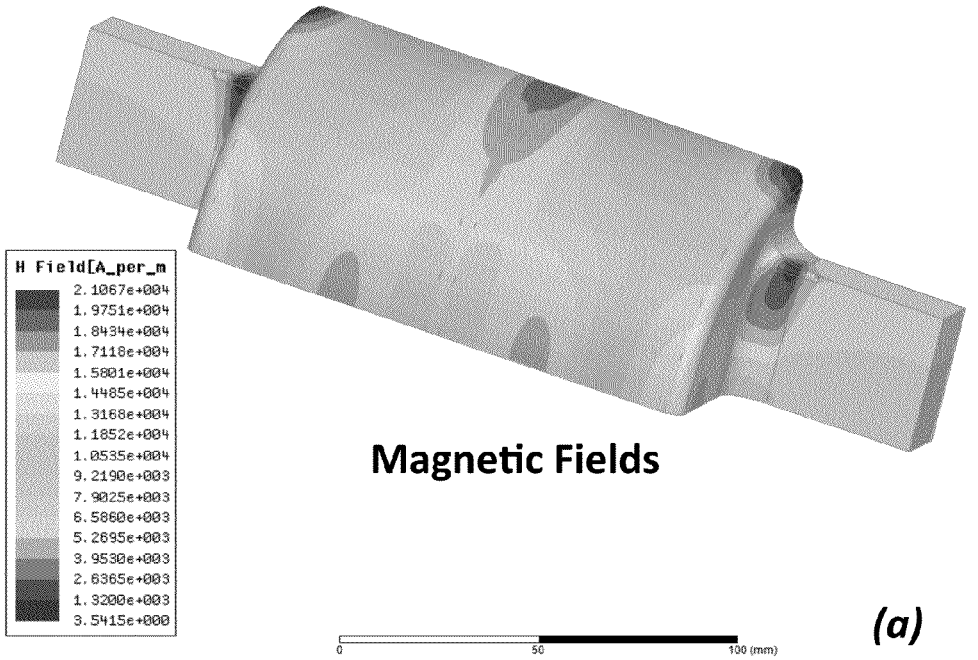
FIGS. 3*a*-3*b* show perspective views of a surface electric field on a window quadrant scaled for 65 MW power transmitted through the whole high-power S-band RF window, according to one embodiment of the invention. The fields here are shown for a specific window, field magnitudes will be different in case of different frequency bands.
Figure 3:
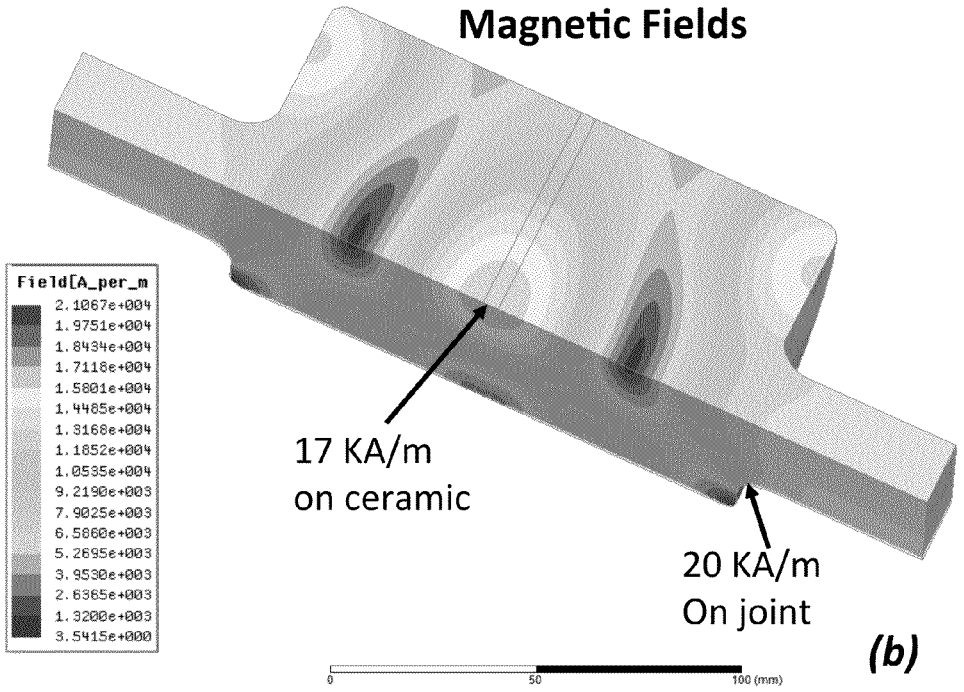

FIGS. 3*a*-3*b* show that the maximum magnetic field on the metal at the joints is 20 kA/m and the maximum magnetic field on the ceramic it is 17 KA/m as shown in FIG. 3*b*.

Figure 4:
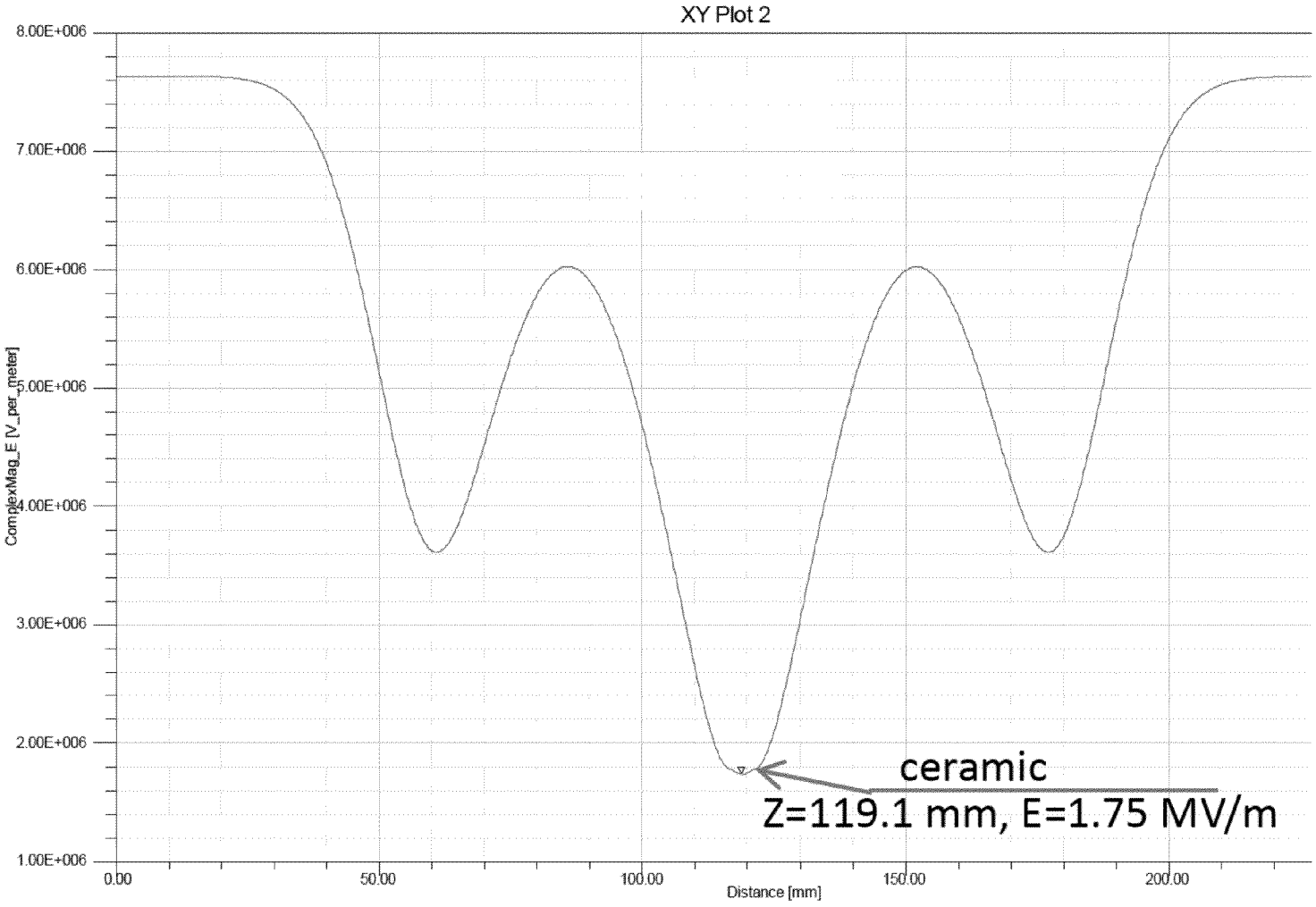
FIGS. 4-5 show plots of electric and magnetic fields on the centerline in the ceramic, respectively, according to one embodiment of the invention.
Figure 5:
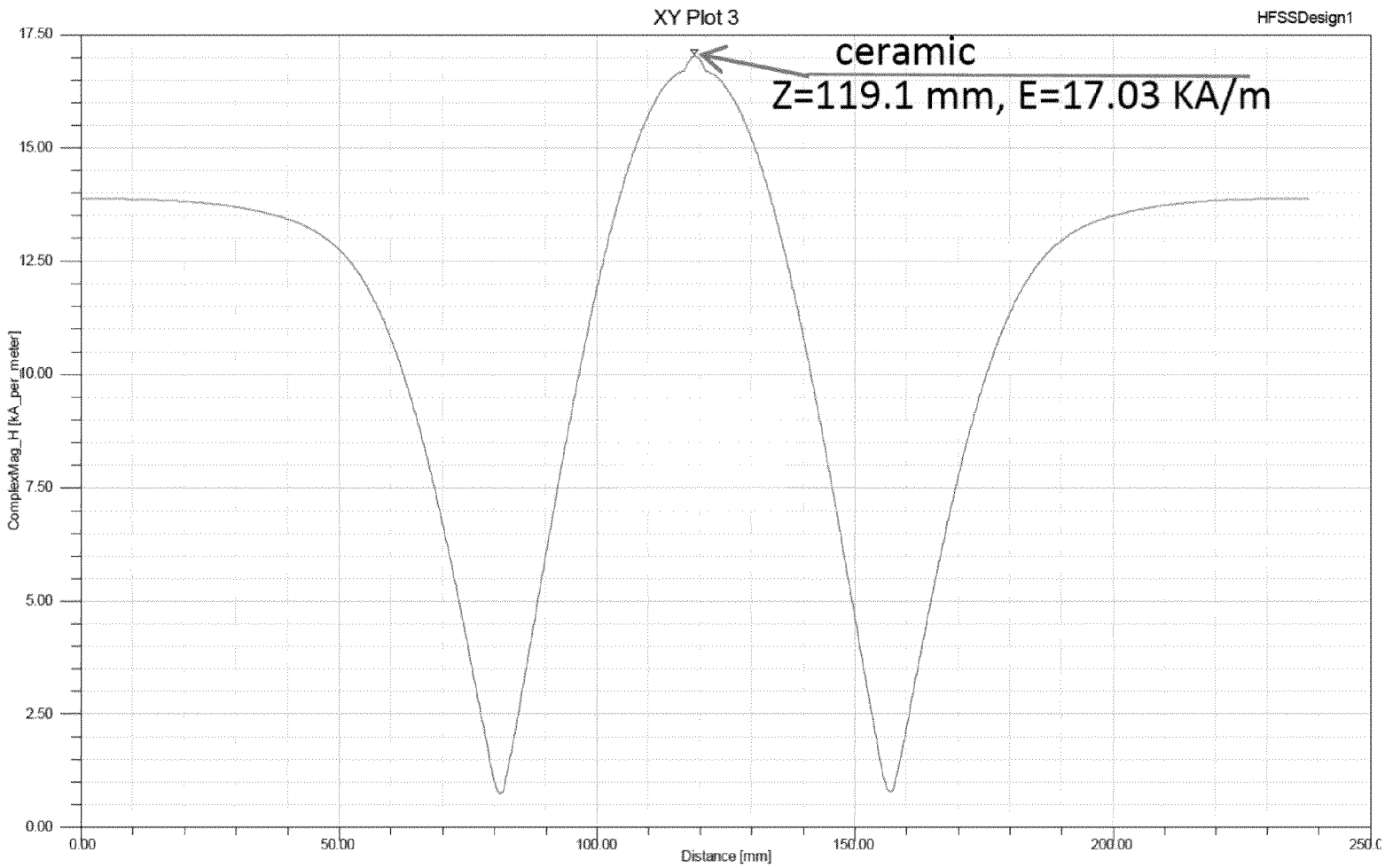

FIGS. 4-5 show plots of electric (FIG. 4) and magnetic fields (FIG. 5) versus the distance through the waveguide, which show E=1.75 MV/m on the centerline in the ceramic, and E=17.03 KA/m on the centerline in the ceramic, respectively, according to one embodiment of the invention.

As a comparison, the SLAC 5045 klystron uses a dual window, and each window has a maximum electric field of 11.6 MV/m on the circular to rectangular waveguide joint and 3.3 MV/m on the ceramic and 11.6 MV/m on the circular to rectangular waveguide joint and 3.3 MV/m on the ceramic with half of 65 MW transmitted through each window. The new design is a vast improvement considering that only one window is needed instead of two for the same function.

The trapped and ghost modes for this window were investigated. The study included the variation in the ceramic permittivity and thickness based on manufacturing variation. It was found that the nearest ghost mode is more than 200 MHz away from the nominal 2856 MHz mode. The closest trapped mode is more than 60 MHz away.

An exemplary S-band window is provided which comfortably operates at 65 MW, has much lower surface fields than the current S-band windows on the SLAC 5045 klystrons, and a single window of the design offered here can replace the dual window of the 5045.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. For example the cross-section of the of the window could have other shape than circular, or shape of the joint between the input waveguide and the waveguide with a window could be modified to accommodate specific manufacturing process.

All such variations are considered to be within the scope and spirit of the present invention as defined by the following claims and their legal equivalents.

What is claimed:

1. A high-power microwave RF window, comprising:

a. a cylindrical waveguide, wherein said cylindrical waveguide comprises a ceramic disk concentrically housed in a central region of said cylindrical waveguide;

b. a first rectangular waveguide, wherein said first rectangular waveguide is connected by a first elliptically-shaped joint to a proximal end of said cylindrical waveguide; and c. a second rectangular waveguide, wherein said second rectangular waveguide is connected by a second elliptically-shaped joint to a distal end of said cylindrical waveguide, wherein said elliptically-shaped joint spans from a flat surface of said rectangular waveguide to a wall of said cylindrical waveguide, wherein said elliptically-shaped joint is disposed to create a traveling wave inside said ceramic disk and disposed to minimize an electric field on a surface of said ceramic disk and disposed to minimize an electric field inside said ceramic disk.

2. The high-power microwave RF window according to claim 1, wherein said high-power microwave RF window is capable of supporting said traveling wave inside said ceramic disk.

3. The high-power microwave RF window according to claim 1, wherein said high-power microwave RF window is capable of separating vacuum from atmospheric pressures in a klystron microwave system.

4. The high-power microwave RF window according to claim 1, wherein said high-power microwave RF window is capable of operating in a multi-tens of megawatt power environment.

5. The high-power microwave RF window according to claim 1, wherein said high-power microwave RF window is capable of minimizing a normal component of an electric field on said ceramic disk.

6. The high-power microwave RF window according to claim 1, wherein said high-power microwave RF window is capable of minimizing a surface magnetic and electric fields on the first and second elliptical joints between the circular waveguide and the respective first and second rectangular waveguides.

* * * * *